United States Patent [19]

Thebert

[11] 4,248,569

[45] Feb. 3, 1981

[54] STATOR MOUNTING

[75] Inventor: Glenn W. Thebert, Carmel, Ind.

[73] Assignee: General Motors Corporation, Detroit, Mich.

[21] Appl. No.: 959,750

[22] Filed: Nov. 13, 1978

[51] Int. Cl.[3] ..... F01D 25/26

[52] U.S. Cl. ..... 415/138; 415/139

[58] Field of Search ..... 415/134, 135, 136, 137, 415/138, 139, 217

[56] References Cited

U.S. PATENT DOCUMENTS

| | | | |
|---|---|---|---|
| 2,427,244 | 9/1947 | Warner | 415/136 |
| 2,488,875 | 11/1949 | Morley | 415/136 |
| 3,151,841 | 10/1964 | Henny | 415/178 |
| 3,302,926 | 2/1967 | Bobo | 415/136 X |
| 3,314,653 | 4/1967 | Bell | 415/134 |
| 3,532,437 | 10/1970 | Strub | 415/136 |
| 3,824,031 | 7/1974 | Gilbert | 415/135 |
| 4,076,451 | 2/1978 | Jankot | 415/217 |

FOREIGN PATENT DOCUMENTS

| | | | |
|---|---|---|---|
| 834178 | 5/1960 | United Kingdom | 415/136 |
| 853997 | 11/1960 | United Kingdom | 415/138 |

*Primary Examiner*—Leonard E. Smith

*Attorney, Agent, or Firm*—J. C. Evans

[57] ABSTRACT

A turbine rotor shroud is mounted by means for rigidly supporting it on an internal bearing for turbine and shaft components of a gas turbine engine and a low rate flexible seal member extends between the outer case of the gas turbine engine and an outer gas flow path wall for maintaining continuity of gas and air stream pass through the gas turbine engine during different modes of engine operation thereby to maintain a closely controlled clearance between blade tips of a row of turbine blades on a rotor connected to the gas turbine engine drive shaft and the rotor shroud to maintain close clearance under mechanical (static or dynamic) loads wherein the deflected rotor or engine casing systems move but the motion is accommodated by the flexible seal member and prevented by a rigid nozzle to turbine bearing support structure.

2 Claims, 2 Drawing Figures

STATOR MOUNTING

Figure 1:
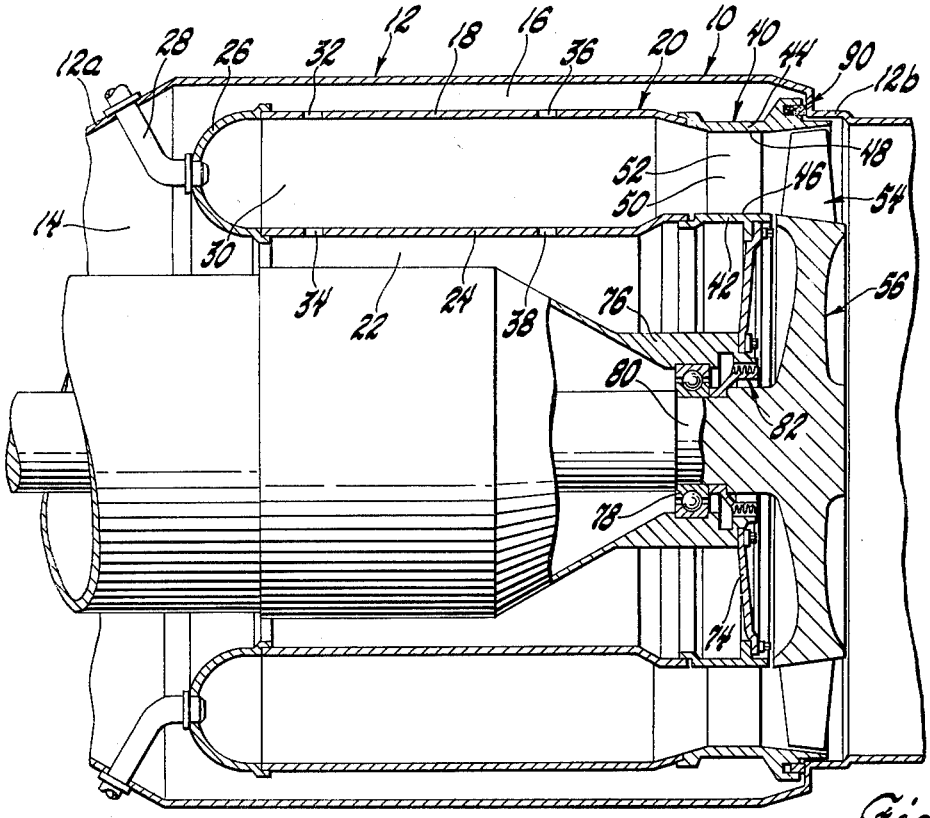

This invention relates to gas turbine engines and, more particularly, to stator mounting configurations for maintaining clearance control between turbine blade tips and an annular outer shroud in surrounding relationship thereto.

Various proposals have been suggested that support a shroud of a gas turbine with respect to blade tips of a gas turbine rotor assembly to control clearance therebetween thereby to reduce gas bypass between blades in the blade row of a gas turbine that is driven by gas flow through the engine. One such arrangement is set forth in U.S. Pat. No. 3,824,031, issued July 16, 1974, to Gilbert for Turbine Casing for a Gas Turbine Engine. In this arrangement, during operation, differential thermal expansion between the hot segments and the cold casing of the engine is accommodated by deformation of struts for supporting separate arcuate segments of the shroud. The segments surround the blade tips of a turbine rotor. The strut and segments deflect to accommodate thermal expansion while each of the shroud segments remain concentric with respect to outer tips of blades on a turbine wheel. Accordingly, reduced clearance can be held between the tips of the turbine blades and the surrounding arcuate shroud segments. Such an arrangement, however, requires formation of a specially configured shroud which can add to the weight of a gas turbine engine assembly.

An outer shroud support for an automotive-type gas turbine engine is set forth in U.S. Pat. No. 3,151,841 issued Oct. 6, 1964 to Henny for Fixed Nozzle Support. In the Henny arrangement, nozzle vanes are mounted to an internal bearing support through an axially extending conical member and the outer shroud is formed of comparatively low expansion metal or ceramic material to accommodate the radial thermal expansion of the rotor. Accordingly, the design compensates for swings in temperature of operation of the device thereby to hold a desired clearance between the tips of blades on the turbine with respect to the inner surface of the outer shroud member.

An object of the present invention is to provide an improved turbine shroud arrangement wherein turbine blade tip clearance control is maintained for improved gas turbine engine performance by the provision of means that rigidly support the inner shroud ring of an inlet turbine nozzle and rotor shroud thereon with respect to an internal bearing support for the turbine rotor and means that flexibly support the nozzle and shroud relative to a cold outer casing so as to control radial movements of the gas flow path through the nozzle and turbine related to deflections between hot and cold running components of the gas turbine.

Another object of the present invention is to provide an improved stator mounting configuration for a gas turbine engine having a nozzle vane ring connected by a rigid support member with respct to an internal bearing support of a gas turbine engine rotor and wherein the nozzle ring includes a trailing shroud component thereon located in surrounding relationship to blade tips of the gas turbine engine rotor and wherein means are provided to fixedly couple static and rotating gas flow paths of the gas turbine engine defined by flow path members including the nozzle vanes, shroud wall and rotor blades to move in unison while an outer band or ring of the nozzle and the shroud defining the rotor blade track of the gas turbine are sealed to the cold outer case through a member more flexible than the rigid support member thereby to isolate flow path defining members from a colder operating outer case.

Still another object of the present invention is to provide an improved stator mounting configuration for a gas turbine engine including a gas flow path defined by an inlet nozzle having an inner band and an outer band; the outer band being connected to a trailing shroud member having an inner surface defining a rotor blade track in close spaced relationship to the radial outer tip of turbine blades, the outer band and the rotor track forming shroud member being associated with means for flexibly coupling them to an outer case for free expansion with respect thereto and wherein means are provided to rigidly connect the inner band of the inlet nozzle with respect to an internal bearing support for the turbine rotor so that the inlet nozzle, and rotor blades along with the shroud member expand together as a unit with respect to a colder operating outer case of the gas turbine engine.

Further objects and advantages of the present invention will be apparent from the following description, reference being had to the accompanying drawings wherein a preferred embodiment of the present invention is clearly shown.

Figure 2:
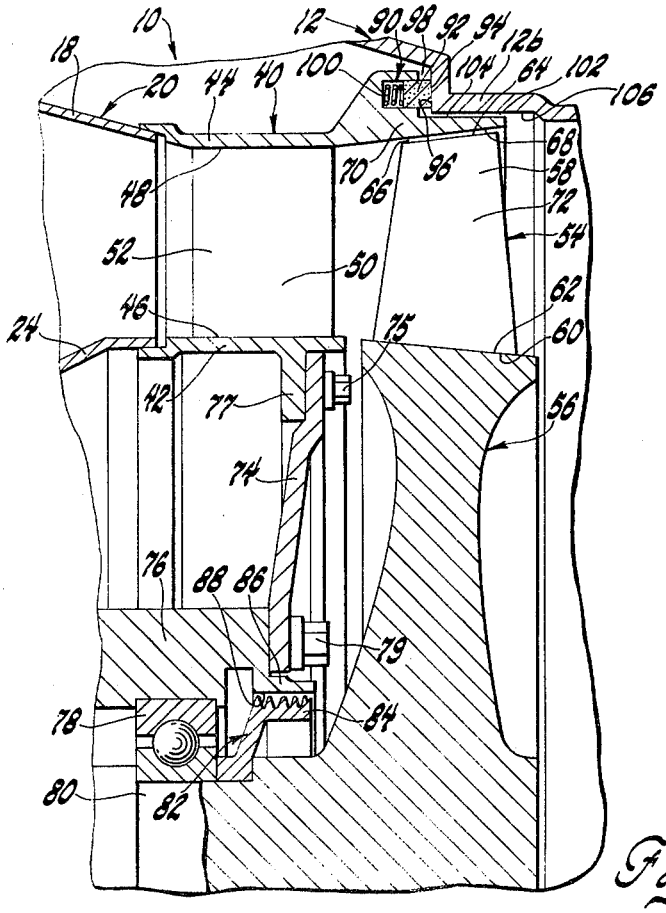

FIG. 1 is a fragmentary, diagrammatic view of a mid-section of a gas turbine engine including the stator mount arrangement of the present invention; and FIG. 2 is a fragmentary, enlarged cross-sectional view of the stator mount assembly of the present invention.

Referring now to drawings, a mid-section of a gas turbine engine 10 is illustrated. Engine 10 includes an outer case 12 having an inlet section 12*a* and an outlet section 12*b*. Section 12*a* surrounds a diffuser passage 14 that directs compressed air from a compressor rotor to an annular passage 16 located in surrounding relationship to an annular outer wall 18 of a gas turbine engine combustor 20 and also into an annular passage 22 in surrounding relationship to the inner annular wall 24 of the combustor 20. The combustor 20 includes an annular dome 26 thereon with a fuel supply nozzle 28 for directing fuel into a combustion zone 30 to be combusted with air directed into the zone 30 through primary holes 32, 34 formed at the upstream end of the annular walls 18, 24 of the combustor 20. If desired, secondary air holes 36, 38 can be formed downstream in the annular combustor walls 18, 24 respectively, to complete the combustion process. Exhaust flow from the combustor 20 is through a turbine inlet nozzle 40 having an inner annular ring or band 42 and an outer annular ring or band 44 defining an annular internal flow surface 46 and an annular external flow surface 48 around a plurality of axially formed gas flow nozzle passages 50 that are separated by a plurality of nozzle vanes 52, one of which is illustrated in FIGS. 1 and 2. The nozzle vanes 52 direct combustion products across a blade row 54 on a turbine rotor 56 of the engine. The blade row 54 is made up of a plurality of radially directed blades 58 with a root portion 60 thereon fixedly secured to the rim 62 of the rotor 56. Each of the blades 58 further include an outer radial blade tip 64 thereon. In such an arrangement, it is desired to maintain a closely controlled tip clearance shown at 66 in FIG. 2 with respect to an inner surface 68 of an outer shroud. In the illustrated arrangement the outer shroud for the blades 58 is formed as a shroud extension 70 from the outer ring 44 of the inlet nozzle 40 so that radial thermal expansion of the inlet nozzle 40 will complement that of the shroud extension 70 that has the inner surface 68 thereon defining a track for the blade tips 64. Each pair of rotor blades 58 has a gas flow passage 72 therebetween axially downstream of the gas flow nozzle passages 50 through the turbine inlet nozzle 40.

In accordance with certain principles of the present invention, the inner band or ring 42 of the inlet nozzle 40 is connected by a rigid support member 74 to a fixed bearing housing 76 that is fixedly secured to the outer case 10. More particularly, a plurality of screws 75 fasten the radially outboard end of member 74 to an annular dependent flange 77 on ring 42. Screws 79 fasten member 74 to housing 76. The bearing housing 76 and rigid support member 74 constitute a fixed reference point for radial thermal growth of both the inlet nozzle 40 and the turbine rotor 56 with respect to the outer case 10. Specifically, the bearing support member 76 supportingly receives a shaft bearing 78 that supports a drive shaft 80 for the gas turbine rotor 56 for rotation with respect to the housing components of the gas turbine engine. A labyrinth seal assembly 82 includes a rotor segment 84 fixedly secured to the rotor 56 for rotation therewith and a stator segment 86 having an annular seal surface 88 thereon to prevent gas bypass between low and high pressure regions within the gas turbine engine.

Additionally, the improved stator arrangement of the present invention includes a flexible seal assembly 90 to physically decouple previously described flow path components from the outer case 10. More particularly, the flexible seal member includes an annular seal 92 including a wear face 94 thereon that slidably sealingly engages a reference surface 96 on the outer case to close an axial gap 98 between the shroud extension 70 and the outer case 12 at an aft portion **12*b* thereon. The annular seal 92 is biased into a sealed relationship with a housing 10 by a spring component 100 that yields to permit axial and radial expansion between heated components of the gas turbine engine and colder outer case components thereof. To accommodate such radial expansion, a clearance gap 102 is provided between the outer surface 104 of the shroud extension 70 and an internal surface 106 on the outer housing extension 12*b***.

In operation, the component parts of the gas turbine engine under cold conditions are as shown in FIG. 2. As hot gas flows through the turbine inlet nozzle 40 and the turbine rotor blade row 54, the component parts will be heated at a rate to cause thermal expansion thereof which will produce a radial growth with respect to the fixed bearing housing 76. Since the support 74 is rigid and the flexible seal 90 is configured to prevent restraint of outer radial growth of the outer wall components of the gas flow passages 50, 72, the inlet nozzle 40 and turbine rotor 56 will thermally expand in a radial direction without restraint. The component parts thereof are selected so that the gas flow passages 50, 72 will be maintained in axial flow alignment. Also, the blade tip clearance 66 between the tips 64 and the inner surface 68 of the shroud extension 70 will be maintained constant because the static and rotating flow passages 50, 72 and associated parts are arranged to thermally grow in unison in a radial direction. Moreover, the outer flow path members including the vane outer band or ring 44 and the rotor blade track forming shroud extension 70 can thermally grow in a radial direction without restraint by provision of the flexible seal 90 and its location with respect to the outer case 12 so as to isolate the flow path members from the outer case 12.

In accordance with the present invention the rigidity of the support member 74 is substantially greater than that of the flexible coupling between the seal assembly 90 and the outer case 12 to assure freedom of movement and a resultant maintenance of close clearance 66 between the blade tips 64 and the surface 68.

Also, when mechanical deflection of housing 76 with respect to case 12 occurs clearance 66 is maintained due to stiff rigid support member 74, with any such motion being accommodated by seal assembly 90.

The embodiments of the invention in which an exclusive property or privilege is claimed are defined as follows:

1. A turbine nozzle vane support assembly comprising an outer housing, an annular inlet nozzle with a plurality of circumferentially spaced radial turbine nozzle vanes, said nozzle having an outer ring and an inner ring joined to said vanes to define flow paths therethrough, a rigid support member, means for rigidly securing said support member to said inner ring so as to prevent relative movement therebetween, an internal bearing support housing including a bearing assembly, means rigidly connecting said rigid support member to said bearing housing, a turbine shaft rotatably supported by said bearing assembly for rotation with respect to said bearing support housing and for radial movement with said rigid support member, said outer ring having a trailing rotor blade track extension thereon located axially rearwardly of said outer ring and defining an inner surface, a gas turbine rotor connected to said shaft including a plurality of radial blades thereon each having a tip located in close spaced relationship to the inner surface, said turbine rotor being supported rigidly by said support member with respect to said inner and outer rings to cause simultaneous deflection of the rotor shaft and said inner and outer ring to maintain a straight flow path through the nozzle vanes and rotor blades, and flexible seal means interconnected between said inlet nozzle and said outer housing to seal against gas bypass between a region supplying air to the combustor and a downstream exhaust from the gas turbine engine during such simultaneous deflection, said rigid support member having less tendency to deflect when subject to thermal and mechanical loads than said flexible seal means, said rigid support member and said flexible seal means together producing uniform mechanical deflection of said nozzle and said rotor to ensure continuous alignment of the flow path through said nozzle and the flow path through said blades on the rotor as well as uniform displacement of the outer flow path members defined by the outer ring and the rotor blade track extension thereby to maintain a close running clearance between the blade track inner surface and the outer tips in response to changes in the operating temperature and mechanical deflection within the gas turbine engine.

2. A turbine nozzle vane support assembly comprising an outer housing, a plurality of circumferentially spaced radial turbine nozzle vanes, an outer ring connected to each of said vanes for defining an outer annular gas flow surface in communication with an outlet of an upstream combustor of a gas turbine engine, an inner ring connected to each of said vanes for defining an inner gas flow surface from the outlet of an upstream combustor, a rigid support member, means for rigidly connecting said support member to said inner ring so as to prevent relative movement therebetween, an internal bearing support housing including a bearing assembly, means rigidly connecting said rigid support member to said bearing housing, a turbine shaft rotatably supported by said bearing assembly for rotation with respect to said bearing support housing and for radial movement with said rigid support member, said outer ring having a trailing rotor blade track extension thereon located axially rearwardly of said outer ring and defining an inner surface extending the outer annular gas flow surface downstream of said nozzle vanes, a gas turbine rotor connected to said shaft including a plurality of radial blades thereon each having a tip located in close spaced relationship to the inner surface of said rotor blade track extension, said turbine rotor being supported rigidly by said support member with respect to said inner and outer rings to cause simultaneous deflection of the rotor shaft and said inner and outer rings to maintain a straight flow path through the nozzle vanes and rotor blades, and flexible seal means interconnected between said rotor blade track extension and said outer housing to seal between a region supplying air to the combustor and a downstream exhaust from the gas turbine engine during such simultaneous deflection, said rigid support member having less tendency to deflect when subject to mechanical loads than said flexible seal means, said rigid support member and said flexible seal means together producing uniform mechanical deflection of said nozzle vanes and said rotor as a unit to ensure continuous uniform displacement of the flow path through said nozzle vanes and the flow path through said blades on the rotor as well as uniform displacement of the outer flow path members defined by the outer ring and the rotor blade track extension thereby to maintain a close running clearance between the blade track inner surface and the outer blade tips during changes in the operating temperature and mechanical deflection within the gas turbine engine.

* * * * *